US006679210B2

(12) United States Patent
Iijima

(10) Patent No.: US 6,679,210 B2
(45) Date of Patent: Jan. 20, 2004

(54) ROCKER ARM FOR INTERNAL COMBUSTION ENGINE

(75) Inventor: Akira Iijima, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 10/144,902

(22) Filed: May 14, 2002

(65) Prior Publication Data

US 2002/0170515 A1 Nov. 21, 2002

(30) Foreign Application Priority Data

May 17, 2001 (JP) ..... 2001-148157

(51) Int. Cl.[7] ..... F01M 1/06

(52) U.S. Cl. ..... 123/90.36; 123/90.39; 123/90.34

(58) Field of Search ..... 123/90.36, 90.39, 123/90.44, 90.4–90.47

(56) References Cited

U.S. PATENT DOCUMENTS

| | | | | |
|---|---|---|---|---|
| 2,435,727 A | | 2/1948 | Spencer | 74/569 |
| 4,132,196 A | * | 1/1979 | Wherry | 123/90.39 |
| 4,614,171 A | | 9/1986 | Malhotra | 123/90.44 |
| 4,856,466 A | * | 8/1989 | Ting et al. | 123/90.33 |

FOREIGN PATENT DOCUMENTS

| | | |
|---|---|---|
| JP | 3-49304 A | 5/1991 |
| JP | 8-028312 A | 1/1996 |
| JP | 8-049516 A | 2/1996 |
| JP | 8-200019 A | 8/1996 |

* cited by examiner

*Primary Examiner*—Thomas Denion
*Assistant Examiner*—Kyle Riddle
(74) *Attorney, Agent, or Firm*—McCormick, Paulding & Huber LLP

(57) ABSTRACT

The present invention prevents abnormal wear of the friction surfaces surrounding the rocker arm, prevents poor lubrication when the engine is started at low temperature after a long period of shutdown, and improves reliability. A bag-shaped oil sump (24) opening upward is provided in the middle part of the rocker arm main body (17). A roller (15) and a roller pin (16) are provided inside the oil sump (24) and when the engine stops, these are immersed in the oil in the oil sump (24). When the engine stops, the area between the roller (15) and the roller pin (16) is lubricated. Further, when the engine is re-started after a long period of shutdown, until the oil has risen, the area between the roller (15) and the cam (8) can be lubricated using the oil adhering to the roller (15). When the rocker arm (6) oscillates downward, the oil in the oil sump (24) is supplied from the oil exhaust (28) by spraying towards the valve shaft end.

9 Claims, 5 Drawing Sheets

ROCKER ARM FOR INTERNAL COMBUSTION ENGINE

This application is entitled to the benefit of and incorporates by reference essential subject matter disclosed in Japanese Patent Application No. 2001-148157 filed May 17, 2001.

BACKGROUND OF THE INVENTION

1. Field of the Invention

The present invention relates to a rocker arm for an internal combustion engine, and more particularly to a roller-type rocker arm comprising a roller that is in contact with a camshaft in a slidable fashion.

2. Description of the Related Art

In a valve mechanism of an internal combustion engine, a rocker arm connecting to an intake valve or an exhaust valve to increase the lift of the cam of the camshaft is known. Further, there are various friction surfaces surrounding the rocker arm, and a lubrication mechanism described below is employed to lubricate these friction surfaces.

FIG. 3 shows a conventional rocker arm. In the rocker arm 51, one end of the main body of the rocker arm 52 (hereinafter referred to as "main body") is rotatably supported by a rocker shaft 53, and the other end becomes an actuator that presses the shaft-end of the intake valve or exhaust valve (hereinafter referred to as "valve") 54 downward. A roller 55 is rotatably supported through a roller pin 56 in the middle part of the main body 52 in a longitudinal direction. A cam 58 of a camshaft 57 slides in contact with the roller 55 from above. In this valve mechanism, the cam 58 applies downward force to the roller 55, thereby depressing the main body 52. The valve 54 resists a valve spring (not shown in the drawings) and is lifted up. Note that the actuator comprises an adjustment mechanism consisting of a cap 60 having a ball screw 59 and a spherical seat 60*a*, and a locking nut 61.

In this construction, friction surfaces exist between a push 72 attached to the main body 52 and the rocker shaft 53, between the roller 55 and the roller pin 56, between the roller 55 and the cam 58, between the ball screw 59 and the spherical seat 60*a*, and between the cap 60 and the shaft-end surface 54*a*. Accordingly, a lubrication mechanism is employed to lubricate these friction surfaces.

In other words, lubricating oil sent from the engine's oil pump flows through a shaft hole 62 inside the rocker shaft 53, and this oil is supplied to the friction surfaces between the push 72 and the rocker shaft 53 by an oil hole 63 that branches off in a radial direction. Subsequently, the oil is guided from an oil hole 64 inside the main body 52 to an oil passage 65 inside the roller pin 56. Since the exit of the oil passage 65 opens to the external circumference of the roller pin 56, the area between the roller 55 and the roller pin 56 is lubricated. Additionally, the oil is transmitted to both surfaces of the roller 55 by a centrifugal force, and is sprayed in an external radial direction, thereby lubricating the area between the roller 55 and the cam 58. Further, the oil sprayed from the cam 58 by the centrifugal force reaches between the ball screw 59 and the spherical seat 60*a*, and between the cap 60 and the shaft-end surface 54*a*, thereby lubricating the friction surfaces.

As shown in FIG. 4, the roller insertion part of the main body 52 is an opening 66 that runs above and below. Reference numerals 67 and 68 depict the push insertion hole and the roller pin insertion hole respectively. The roller pin 56 is constituted as shown in FIGS. 5*a*–5*c* and is fixed by pressure in the roller pin insertion hole 68. The oil passage 65 consists of a first hole 69 connected to the oil hole 64 of the main body 52, a second hole 70 extending downward from the first hole 69 axially at a slope, and a taper hole 71 formed to open into the middle part of the pin, which constitutes the exit of the second hole 70 and the oil passage 65. The oil flowing out of the taper hole 71 lubricates the area between the roller 55 and the roller pin 56.

However, when the engine stops, oil flows down from the moving valves, including the rocker arm, to the oil gallery. On the other hand, when the engine starts up, it takes time for the oil to flow up from the oil gallery to the shaft hole 62 in the rocker shaft 53. Even more time is required until the oil reaches each sliding part described above. This is even more so if the oil temperature is low when the engine starts up. Accordingly, when the engine is started up under low temperature conditions after a long period of shutdown, sliding occurs without lubrication for a comparatively long period of time, and there is the possibility of causing abnormal wear, particularly of the roller pin 56, the roller 55, the cam 58 and the valve shaft-end surface 54*a*.

Therefore, the present invention was designed with the foregoing problems in view, and it is an object of the present invention to prevent abnormal wear of the friction surfaces surrounding the rocker arm, while also improving reliability by preventing poor lubrication under conditions which are disadvantageous to lubrication, such as when an engine is started up at low temperature after a long period of shutdown.

SUMMARY OF THE INVENTION

A rocker arm for an internal combustion engine according to the present invention comprises a bag-shaped oil sump opening upward in the rocker arm main body, and an oil supply port and oil exhaust to conduct the supply and discharge of oil to and from the oil sump as well as control the oil level height of the oil sump. A roller is rotatably provided inside the oil sump and the bottom end of this roller is positioned lower than the oil level height so that at least the bottom end of the roller will be immersed in the oil in the oil sump.

Therefore, when the engine is stopped, the oil in the oil sump adheres to the roller, so that when the engine is started up again, until the time that the oil rises up, the oil adhering to the roller is used and the area between the roller and the cam can be lubricated. In addition, due to the rotation between the roller and the cam, oil can be sprayed onto other friction surfaces. Accordingly, poor lubrication can be prevented even when starting the engine up at low temperature after a long period of shutdown.

Here the roller is mounted to the rocker arm main body and is rotatably supported by a roller pin inserted into the centre of the roller, and it is desirable that the bottom end of this roller pin is positioned lower than the oil level height so that at least the bottom end of the roller pin will be immersed in the oil in the oil sump.

Therefore, when the engine is stopped, the oil in the oil sump is able to adhere to the sliding part between the roller and the roller pin as well, and the problem of poor lubrication can be further eliminated.

It is desirable that the oil supply port is formed so as to penetrate the rocker arm main body, and comprises an entry hole to guide the oil from the shaft passage inside the rocker shaft to the oil sump. It is desirable that the oil exhaust is formed so as to penetrate the rocker arm main body, and consists of an exit hole to supply oil from the oil sump by spraying it near the valve shaft-end.

Therefore, the oil supply port and oil exhaust can be drilled and the drilling process can be conducted with greater ease and at less cost. Further, abnormal wear of the valve shaft-end surface can be prevented, since oil from the oil sump is supplied by spraying near the valve shaft-end.

Further, the valve mechanism of an internal combustion engine according to the present invention is a valve mechanism of an internal combustion engine, which comprises a rocker arm main body, of which one end is rotatably supported by the engine's rocker shaft, and the other end forms an actuator to press the shaft-end of the intake valve or exhaust valve downward, and a roller rotatably supported by a roller pin in the middle part of the rocker arm main body, a camshaft being in contact with the roller from above in a slidable fashion, wherein a shaft passage is formed inside the rocker shaft, so that lubricating oil is supplied from the engine's oil pump through this shaft passage, and a bag-shaped oil sump is defined in the rocker arm main body, so as to contain the roller and roller pin and to open upwards;

the rocker arm main body is provided with an entry hole to guide oil from said shaft passage into the oil sump, and an exit hole to supply oil from said oil sump by spraying near the shaft-end of an intake valve or exhaust valve, formed in said rocker arm main body; and wherein the oil level height of said oil sump is controlled by the height of the openings of the entry hole and the exit hole into the oil sump, and the height of the bottom end of the roller pin is lower than the oil level height so that at least the bottom end of the roller and roller pin is immersed in the oil in the oil sump.

It is desirable that the entry hole is selectively connected to the shaft passage when the rocker arm main body is oscillating downward. This is so that oil expenditure is optimized and oil is not expended wastefully.

DESCRIPTION OF THE PREFERRED EMBODIMENTS

The preferred embodiments of the present invention will be described below, with reference to the attached drawings.

Figure 2:
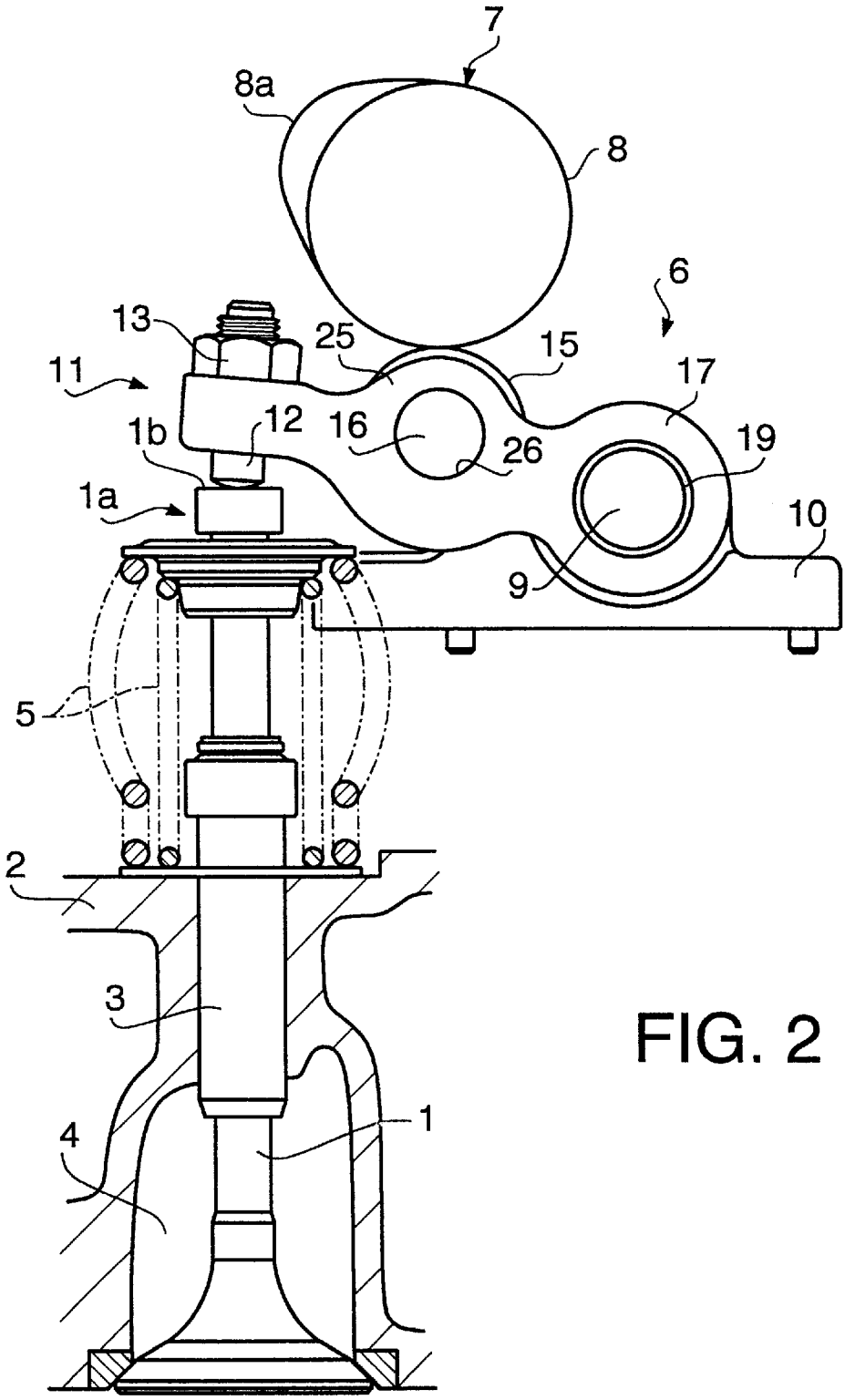
FIG. 2 is a view showing a valve mechanism according to an embodiment of the present invention.
Figure 3:
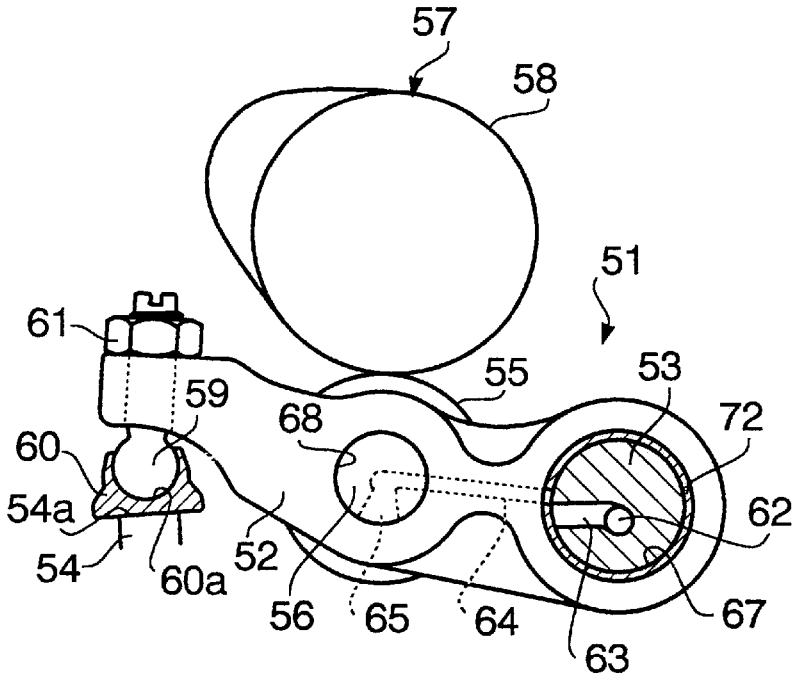
FIG. 3 is a view showing a conventional example.

FIG. 2 shows a valve mechanism of an internal combustion engine according to the present embodiment. A valve 1 that constitutes the intake valve or the exhaust valve is supported inside a valve guide 3 fixed to a cylinder head 2, so that it is able to move up and down, and opens and closes the exit or entry of a port 4 that constitutes the intake port or exhaust port. The valve 1 is continuously impelled upward, in other words, into a closed valve state by a valve spring 5, and a shaft-end la is pressed downward by a rocker arm 6 to press the valve downward and open the valve. The rocker arm 6 is positioned below a cam 8 of a camshaft 7 to increase the amount of lift of the cam 8, and is connected to the valve 1.

A rocker shaft 9 is fixed above the cylinder head 2 through a boss 10 so that it is unable to rotate. One end of the rocker arm 6 in a longitudinal direction is rotatably inserted and supported around the external circumference of this rocker shaft 9, and the rocker arm 6 turns and oscillates up and down with the rocker shaft 9 in its centre. The other end of the rocker arm 6 in a longitudinal direction forms an actuator 11 to drive the valve 1 downward. The bottom end surface is a round surface and has an adjusting mechanism consisting of an adjusting screw 12 that slides in contact with a shaft-end surface 1*b* of the valve 1, and a locking nut 13 that fixes the top and bottom position of the adjusting screw 12. A roller 15 is rotatably supported through a roller pin 16 in the middle part of the rocker arm 6 in a longitudinal direction. The roller 15 is positioned directly under the cam 8 and slides in contact with the cam 8, and force is applied downward from the cam 8 so as to open the valve.

Figure 1:
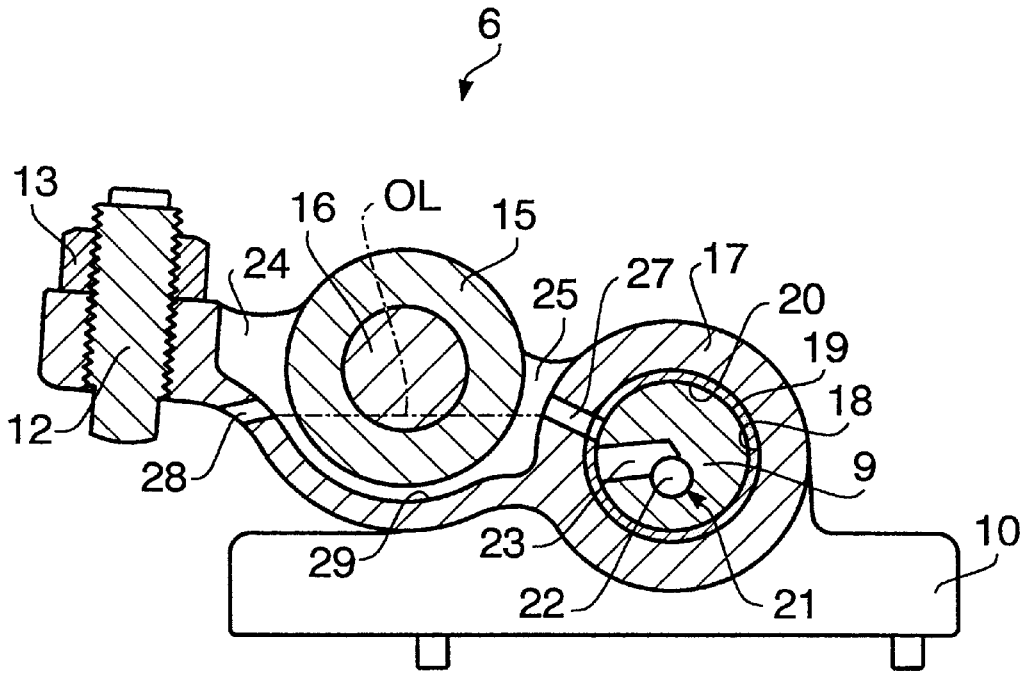
FIG. 1 is a longitudinal sectional view showing a rocker arm according to an embodiment of the present invention.

FIG. 1 shows the rocker arm 6 in detail. The rocker arm 6 comprises mainly of a rocker arm main body 17 made by casting (hereinafter referred to as "main body") with the adjusting screw 12, the locking nut 13, the roller 15 and the roller pin 16 mounted thereto. A push fixing hole 18 is provided in one end of the rocker arm main body 17 in a longitudinal direction, and a thin cylindrical push 19 is attached to this push fixing hole 18. The inside of the push 19 is a shaft insertion hole 20, and the rocker shaft 9 is rotatably inserted through the shaft insertion hole 20 so that the internal circumference of the push 19 and the external circumference of the rocker shaft 9 slide in contact with each other. Inside the rocker shaft 9, an oil pump, more specifically a shaft passage 21 to which oil from the oil gallery is supplied, is formed below. The shaft passage 21 comprises an axial hole 22 extending in a longitudinal direction of the rocker shaft 9, and a radial hole 23 branching off in a radial direction from the axial hole 22.

A bag-shaped oil sump 24 opening upward is provided in a middle part of the main body 17 in a longitudinal direction. The oil sump 24 having a prescribed volume and depth is closed off at the front and back, left and right and bottom, and only the top is open. Both side walls 25 of the oil sump 24 have pin insertion holes 26 (refer to FIG. 2), and the roller pin 16 is fixed by pressure into these pin insertion holes 26. The roller pin 16 is inserted into the centre of the roller 15 rotatably and on the same axis. In this way, the roller pin 16 is fixed and supported at both ends and the roller 15 and roller pin 16 are positioned inside the oil sump 24.

The oil sump 24 and the shaft insertion hole 20 are connected by an entry hole 27. The entry hole 27 is a drilled hole that penetrates through the main body 17 and push 19, and constitutes an oil supply port for supplying and introducing the oil in the shaft passage 21 into the oil sump 24. Similarly, on the opposite side of the entry hole 27 an exit hole 28 is provided connecting the oil sump 24 with the outside. The exit hole 28 discharges the oil from the oil sump 24 and constitutes an oil exhaust for supplying by spraying oil near the shaft-end la of the valve 1. More specifically, the exit hole 28 is a drilled hole that is oriented so as to supply oil by spraying it from above at an angle above the valve shaft-end surface 1*b* when the rocker arm 6 is oscillating downward, as will be described later.

The oil level height is shown by the hypothetical line OL. FIG. 1 shows the state when the valve is closed and the rocker arm 6 is not pressed by the cam stack 8*a* (refer to FIG. 2). However, at this time, ordinarily, oil in the oil sump 24 is filled at least up to the oil level height OL that is shown in the drawing. The oil level height OL is controlled by the position of the opening height of the entry hole 27 and exit hole 28 relative to the oil sump 24.

As shown in the drawing, the height of the bottom end of the roller 15 and the roller pin 16 is lower than the oil level height OL, and the bottom end of the roller 15 and the roller pin 16 is immersed in the oil in the oil sump 24. The proportion of the roller 15 that is immersed is approximately ⅓ and the proportion of the roller pin 16 that is immersed is less than this, being just enough to touch the surface of the oil. The bottom wall 29 of the oil sump 24 is slightly separated from the roller 15, and the centre of the roller pin 16 is positioned above the bottom wall 29 at the minimum height.

Next, the application of the present embodiment will be described. When an ordinary engine is being driven, oil discharged from the engine's oil pump is supplied to the shaft passage 21 above, through the oil gallery. Accordingly the friction surfaces between the push 19 and the rocker shaft 9 are lubricated. When the valve 1 shown in the drawing is in a closed state, the rocker arm 6 is in a standard upward position and the entry hole 27 is not connected to the radial hole 23 of the shaft passage 21. Accordingly oil is not supplied to the oil sump 24. Of course, there is oil filled at least up to the oil surface height OL in the oil sump 24 and the friction surfaces of the roller pin 16 and roller 15 are lubricated by this oil. At the same time, while in contact with this oil, the roller 15 is being friction driven by the cam 8 and is rotating, thereby lubricating the friction surfaces of the roller 15 and cam 8 with the oil adhering to the roller 15.

The roller 15 is pressed by the cam stack 8*a*, and when the rocker arm 6 oscillates downward from the state shown in the drawing to an open valve state, the entry hole 27 connects to the radial hole 23 of the shaft passage 21 and the oil in the shaft passage 21 is supplied through the entry hole 27 to the oil sump 24. At the same time, the oil surface slopes toward the end of the rocker arm, so the oil in the oil sump 24 is discharged through the exit hole 28 and is supplied by spraying near the shaft-end 1*a* of the valve 1. Accordingly, the friction surfaces of the adjusting screw 12 and valve shaft-end 1*a* are lubricated. At this time, the other friction surfaces are lubricated in the same way as described above.

In this way each sliding part around the rocker arm is lubricated during driving of the engine.

Next, when the engine stops, the oil flows down to the oil gallery below and the shaft passage 21 is no longer supplied with oil. However, even if the engine is left in this state for a long period of time, oil in the oil sump 24 is always filled up to the minimum oil surface height OL (when the valve is closed), and the friction surfaces of the roller pin 16 and the roller 15, as well as the bottom end of the roller 15 are immersed in the oil. Consequently, when the engine is next started, lubrication is brought about by the oil in the oil sump 24 before the oil rises, and the friction surfaces between the roller 15 and the cam 8, the friction surfaces between the roller pin 16 and the roller 15, and the friction surfaces between the adjusting screw 12 and the valve shaft-end 1*a* (only when the valve is open) can be lubricated by this oil. Further, oil can be sprayed onto the friction surfaces between the adjusting screw 12 and valve shaft-end 1*a* for example, due to the rotation of the roller 15 and the cam 8. In this way, abnormal wear due to poor lubrication when the engine starts up can be prevented. Particularly in situations disadvantageous to lubrication, such as when the engine is started at low temperature after a long period of shutdown, lubrication is possible for a comparatively long amount of time from the beginning of starting up (at least until the oil rises), and it is possible to improve reliability.

Figure 4:
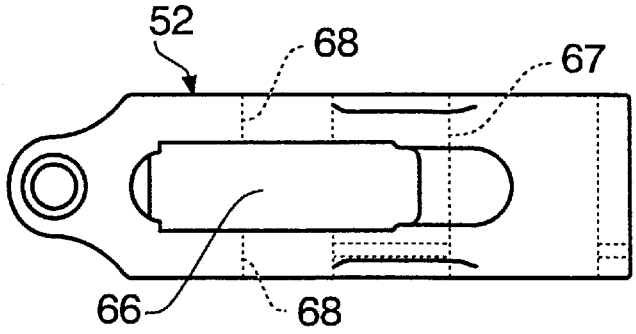
FIG. 4 is a plan view showing a conventional rocker arm main body.
Figure 5A:
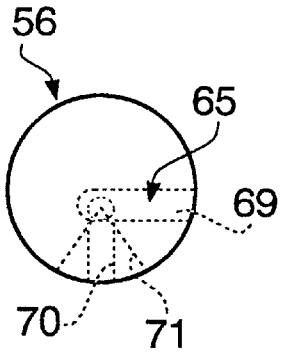
FIG. 5*a* is an elevational view showing a conventional roller pin.
Figure 5B:
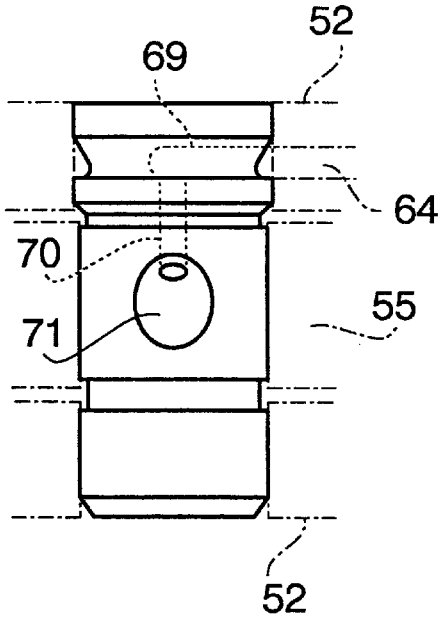
FIG. 5*b* is a bottom view showing the conventional roller pin illustrated in FIG. 5*a;*
Figure 5C:
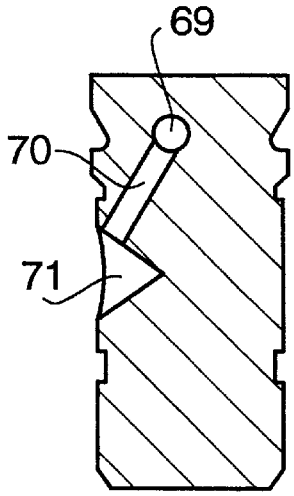
FIG. 5*c* is a right side sectional view showing the conventional roller pin illustrated in FIG. 5*b;*

Further, according to the present embodiment, unlike with conventional-type roller pins (FIGS. 5*a*–5*c*), complicated drilling of holes is not required. It is only necessary to drill 2 holes (the entry hole 27 and the exit hole 28), so it has the advantage that drilling can be carried out more easily and at less cost. Further, the middle part of the main body 17 is bag-shaped and has a U-shaped cross section having a bottom wall 29, so it has the advantage that compared to conventional constructions (FIG. 4) that opened from both the top and the bottom, the present design can improve rigidity. The supply of oil to the oil sump 24 occurs selectively only when the rocker arm 6 is oscillating downward, thereby ensuring that the oil expenditure is appropriate and oil is not expended wastefully.

Next, the characteristics of the present embodiment will be explained in comparison to conventional technology.

Figure 6:
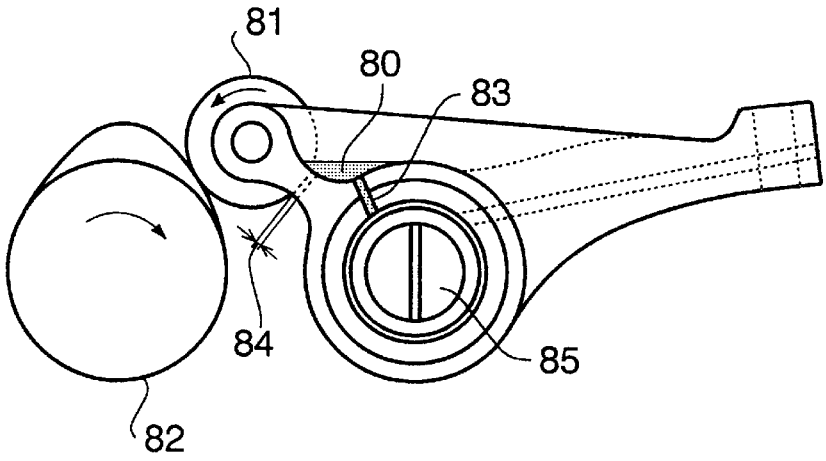
FIG. 6 is a view showing another conventional example.

FIG. 6 shows the kind of construction disclosed in Japanese Patent Application Laid-Open No. H3-49304. In other words, oil is filled into a concave space 80 and this is made to touch the surface of the roller 81 so as to lubricate the friction surfaces between the cam 82 and the roller 81. However, with this construction, since oil leaks from a supply hole 83, a gap 84 and the gaps on both sides of the roller when the engine is stopped, hardly any oil fills up in the concave space 80, the engine is next started up with hardly any oil adhering to the surface of the roller 81, and sliding of the cam 82 in contact with the roller 81 is carried out in a largely non-lubricated state, creating the danger of abnormal wear due to poor lubrication. Further, there is no lubrication between the roller 81 and the roller pin 85. Consequently, the present embodiment has the advantage of being able to eliminate these faults.

Figure 7:
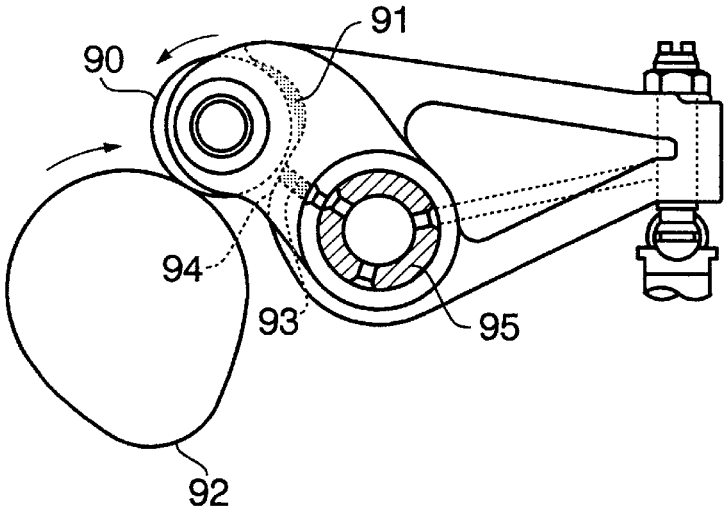
FIG. 7 is a view showing another conventional example.

As shown in FIG. 7, in Japanese Patent Application Laid-Open No. H8-49516 technology is disclosed wherein the oil sump 91 is provided on the side of the roller 90 and the surface of the roller 90 touches the oil in the oil sump 91 to lubricate the friction surfaces between the cam 92 and the roller 90. However, similarly with this construction, oil leaks from a supply hole 93, a gap 94 and the gaps on both sides of the roller when the engine is stopped, and the next time the engine is started, sliding is carried out in a largely non-lubricated state, creating the danger of abnormal wear due to poor lubrication. Further, there is no lubrication between the roller 90 and the roller pin 95. Consequently, the present embodiment has the advantage of being able to eliminate these faults.

Further, in this conventional technology, when the engine is stopped, sludge is discharged together with the oil, but in the present embodiment, when the engine is being driven (particularly during medium to high speed driving), due to the back and forth, up and down movements of the rocker arm 6, the sludge in the oil sump 24 can be sprayed upward and the problem of sludge piling up in the oil sump 24 does not arise. Particularly since the relative density of sludge is greater than oil, it is easier than oil to be sprayed upward. During medium to high speed driving, oil is sprayed upward at the same time, but since at this time oil is sprayed from each place as droplets, even if the oil sump 24 is not filled with oil there is no problem with regard to lubrication.

In this conventional technology, sludge is discharged when the engine is stopped, but conversely, during driving, when oil, which includes sludge is supplied, sludge fills the oil sump 91 and is supplied to the friction surfaces all at once at a particular time, creating the danger of leading to abnormal wear. In internal combustion engines such as fixed-type internal combustion engines used for industry (for example internal combustion engines for power generators) where the engines are stopped infrequently, in the worst case scenario, sludge continues to be supplied to the friction surfaces for a long period of time and this increases the possibility of abnormal wear. In contrast, in the present embodiment, sludge is sprayed during driving so this problem does not occur.

Although not shown in the drawings, in Japanese Patent Application Laid-Open No. H8-28312 an oil passage for oil injection to supply oil by spraying to the friction surfaces of the rocker arm shaft-end is disclosed. However, injection does not occur unless the oil has risen up to the rocker shaft, so oil cannot be injected at the time of starting up before the oil rises. In contrast to this, the present embodiment can supply oil to the friction surfaces between the adjusting screw 12 and the valve shaft-end 1*b* as soon as the rocker arm slopes downward when the engine is being started up and is therefore able to eliminate the faults of this conventional technology.

Note that the embodiments of the present invention can take a variety of other modes. For example, the position of the roller and the roller pin with respect to the oil level height may be lowered and the proportion immersed in oil can be increased. It is even acceptable to immerse the middle or top part of the roller and roller pin in oil. Conversely, although the effect is not as great as in the present embodiment, the position of the roller and the roller pin with respect to the oil level height may be raised, for example by positioning the bottom end of the roller pin at a higher position than the oil level height and only immersing the bottom end of the roller. Even if this is done, due to the rotation of the roller, oil will soon lubricate the friction surfaces between the roller and the roller pin after the engine is started up, and the friction surfaces of the roller and the roller pin can be lubricated by oil that flows down from the sides of the roller, so largely the same effects (at least effects that are superior to the conventional technology) can be achieved. Further the oil supply port and the oil exhaust do not have to be holes drilled in a straight line, but can be formed using a core during the casting of the main body, and can be curved passages or comparatively large openings. Several oil supply ports and oil exhausts may be provided, and if there are other areas to be lubricated, the oil exhaust may be oriented to areas besides the valve shaft-end. The rocker arm does not have to be manufactured by casting, and may be manufactured by forging for example.

The present invention achieves the following superior effects.

(1) It can prevent abnormal wear of the friction surfaces surrounding the rocker arm.

(2) It can prevent poor lubrication in such circumstances as when the engine is started at low temperature after a long period of shutdown, and can improve reliability.

(3) It can lessen the cost.

(4) It can improve rigidity.

What is claimed is:

1. A rocker arm for an internal combustion engine, comprising:

a bag-shaped oil sump opening upward in a rocker arm main body;

an oil supply port and an oil exhaust port to conduct the supply and discharge of oil to and from said oil sump as well as to control the oil level height of said oil sump; and a roller, rotatably provided inside said oil sump with the bottom end of said roller positioned lower than said oil level height so that at least said bottom end of said roller is immersed in the oil in said oil sump.

2. The rocker arm for an internal combustion engine according to claim 1, wherein said roller is mounted to said rocker arm main body and is rotatably supported by a roller pin inserted into the centre of said roller, and the bottom end of said roller pin is positioned lower than said oil level height so that at least said bottom end of said roller pin is immersed in the oil in said oil sump.

3. The rocker arm for an internal combustion engine according to claim 1, wherein said oil supply port is formed so as to penetrate said rocker arm main body, and comprises an entry hole to guide the oil from a shaft passage inside a rocker shaft to said oil sump; and said oil exhaust is formed so as to penetrate said rocker arm main body, and comprises an exit hole to supply oil from said oil sump by spraying it near a valve shaft end.

4. The valve mechanism of an internal combustion engine according to claim 3, wherein said entry hole is selectively connected to said shaft passage when said rocker arm main body oscillates downward.

5. The rocker arm for an internal combustion engine according to claim 2, wherein said oil supply port is formed so as to penetrate said rocker arm main body, and comprises an entry hole to guide the oil from a shaft passage inside a rocker shaft to said oil sump; and said oil exhaust is formed so as to penetrate said rocker arm main body, and comprises an exit hole to supply oil from said oil sump by spraying it near a valve shaft end.

6. The valve mechanism of an internal combustion engine according to claim 5, wherein said entry hole is selectively connected to said shaft passage when said rocker arm main body oscillates downward.

7. A valve mechanism of an internal combustion engine, comprising:

a rocker arm main body, of which one end is rotatably supported by the engine's rocker shaft, and the other end forms an actuator to press the shaft-end of the intake valve or exhaust valve downward; and a roller rotatably supported by a roller pin in the middle part of said rocker arm main body, a camshaft being in contact with the roller from above in a slidable fashion, wherein a shaft passage is formed inside said rocker shaft, so that lubricating oil is supplied from the engine's oil pump through this shaft passage, and a bag-shaped oil sump is defined in said rocker arm main body, so as to contain said roller and roller pin and to open upwards;

said rocker arm main body is provided with an entry hole to guide oil from said shaft passage into said oil sump, and an exit hole to supply oil from said oil sump by spraying near the shaft-end of an intake valve or exhaust valve, formed in said rocker arm main body; and wherein said oil level height of said oil sump is controlled by the height of the openings of said entry hole and said exit hole into said oil sump, and the height of said bottom end of said roller pin is lower than said oil level height so that at least the bottom end of said roller and roller pin is immersed in the oil in said oil sump.

8. The valve mechanism of an internal combustion engine according to claim 7, wherein said entry hole is selectively to said shaft passage when said rocker arm main body oscillates downward.

9. A rocker arm for an internal combustion engine, comprising:

a bag-shaped oil sump opening upward in a rocker arm main body;

an oil supply port and an oil exhaust port to conduct the supply and discharge of oil to and from said oil sump as well as to control the oil level height of said oil sump; and a roller, rotatably provided inside said oil sump with the bottom end of said roller positioned lower than said oil level height so that at least said bottom end of said roller is immersed in the oil in said oil sump, wherein said oil supply port provided in a direction of said roller.

* * * * *